US012152856B2

(12) United States Patent
Miller et al.

(10) Patent No.: US 12,152,856 B2
(45) Date of Patent: Nov. 26, 2024

(54) FIREARM STOCK WITH ADJUSTABLE LENGTH OF PULL

(71) Applicant: Sig Sauer, Inc., Newington, NH (US)

(72) Inventors: Evan Miller, Exeter, NH (US); Zachary A. Amico, Danville, NH (US)

(73) Assignee: SIG SAUER, INC., Newington, NH (US)

( * ) Notice: Subject to any disclaimer, the term of this patent is extended or adjusted under 35 U.S.C. 154(b) by 64 days.

(21) Appl. No.: 18/188,866

(22) Filed: Mar. 23, 2023

(65) Prior Publication Data

US 2023/0304771 A1 Sep. 28, 2023

Related U.S. Application Data

(60) Provisional application No. 63/323,205, filed on Mar. 24, 2022.

(51) Int. Cl.
*F41C 23/04* (2006.01)
*F41C 23/14* (2006.01)

(52) U.S. Cl.
CPC ..... *F41C 23/04* (2013.01); *F41C 23/14* (2013.01)

(58) Field of Classification Search
CPC ..... F41C 23/14; F41C 23/04
See application file for complete search history.

(56) References Cited

U.S. PATENT DOCUMENTS

| | | | | |
|---|---|---|---|---|
| 3,348,328 | A * | 10/1967 | Roy | F41C 23/04 42/73 |
| 9,664,478 | B2 | 5/2017 | Robinson et al. | |
| 10,156,421 | B2 * | 12/2018 | Smith | F41C 23/14 |
| 2004/0031182 | A1 * | 2/2004 | Bentley | F41C 23/04 42/74 |
| 2009/0139128 | A1 * | 6/2009 | Fluhr | F41C 23/04 42/71.01 |
| 2012/0000109 | A1 * | 1/2012 | Zusman | F41C 23/14 42/71.01 |
| 2016/0209161 | A1 * | 7/2016 | Wilson | F41C 23/14 |
| 2017/0356718 | A1 * | 12/2017 | Johnson | F41C 23/20 |
| 2018/0080736 | A1 * | 3/2018 | Olsen | F41C 23/14 |
| 2020/0182586 | A1 * | 6/2020 | Zhang | F41C 23/20 |
| 2020/0240743 | A1 * | 7/2020 | Cahill | F41C 23/14 |
| 2022/0196357 | A1 * | 6/2022 | Wiedemann | F41C 23/20 |
| 2023/0127332 | A1 * | 4/2023 | Keller | F41C 23/04 42/71.01 |

* cited by examiner

*Primary Examiner* — Joshua E Freeman
(74) *Attorney, Agent, or Firm* — Finch & Maloney PLLC

(57) ABSTRACT

A firearm stock includes a stock body slidably mounted on a beam. A lever attached to the stock body can be moved between a locked position, a first unlocked position, and a second unlocked position, where operating the lever moves a locking mechanism between locked and unlocked positions. For example, when the lever is in the first unlocked position, the locking mechanism permits longitudinal adjustment of the stock body along the beam. When the lever is in the second unlocked position the locking mechanism permits the stock body to be slidably removed from the beam. In one example, the lower portion of the stock body defines a plurality of cam pathways for pins that secure the lever to the stock body. Forward cam pathways permit either a pivoting movement about the rear pin or a downward and forward shifting movement.

20 Claims, 11 Drawing Sheets

FIREARM STOCK WITH ADJUSTABLE LENGTH OF PULL

RELATED APPLICATIONS

This application claims the benefit under 35 U.S.C. § 119(e) of U.S. Provisional Patent Application No. 63/323,205 filed on Mar. 24, 2022, the contents of which are incorporated herein by reference in its entirety.

FIELD OF THE DISCLOSURE

The disclosure relates generally to firearms and more particularly to a firearm stock with an adjustable length of pull.

BACKGROUND

Firearm design involves a number of non-trivial challenges, including the design of the firearm stock. The stock is an interface between the shooter and the rifle and transfers recoil from the rifle to the shooter. The stock includes a butt plate constructed to engage the shooter's shoulder and is the primary anchor point of the stock. The stock also has a comb generally configured to engage the shooter's cheek. The shooter can use the butt plate to firmly brace the rifle against the shoulder for stability while aiming. The shooter's cheek contacts the comb while aligning the shooter's eyes with the rifle sights to obtain a sight picture. A good fitting stock facilitates rapid target acquisition and precise shot placement in addition to enhancing the shooter's ability to hold the rifle still for the shot. Adjustments to a firearm stock include optimizing the length of pull and comb height to facilitate precise positioning the rifle against the body. Such adjustments are available in some stocks, but a number of non-trivial challenges remain.

Figure 1:
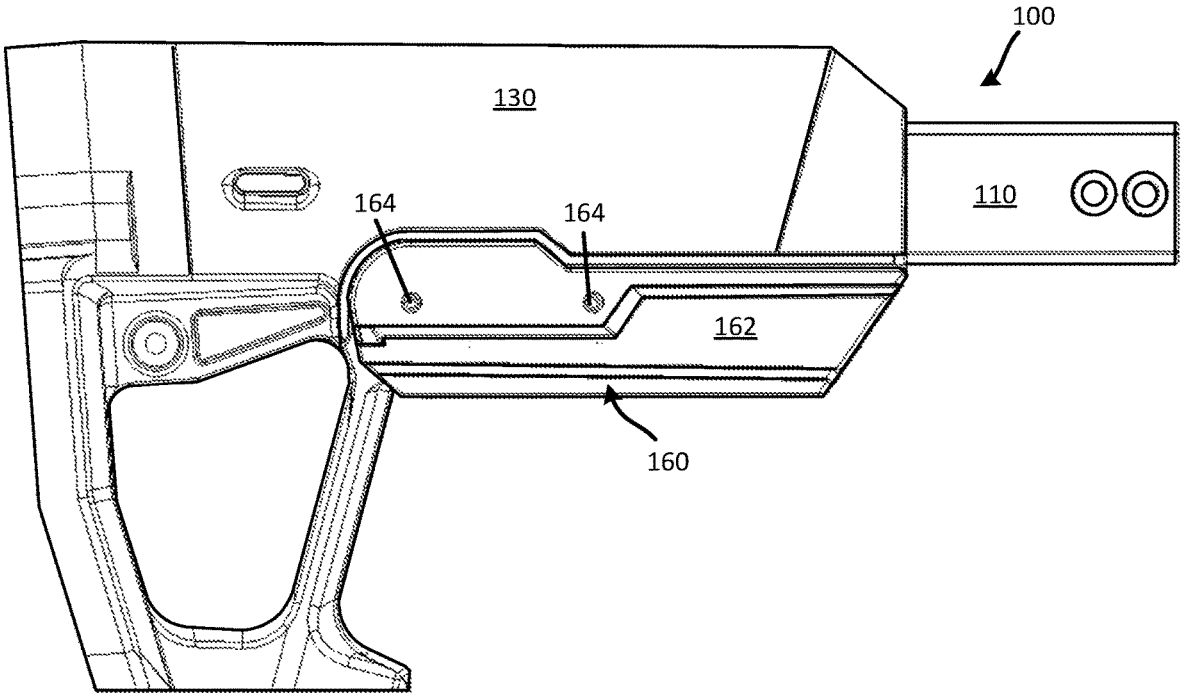
FIG. 1 illustrates a side view of a stock assembly with a locking mechanism in a locked position, in accordance with an embodiment of the present disclosure.

These and other features of the present embodiments will be understood better by the following detailed description, taken together with the figures herein described. For purposes of clarity, not every component may be labeled in every drawing. Furthermore, as will be appreciated, the figures are not necessarily drawn to scale or intended to limit the claimed invention to the specific configurations shown. Numerous variations and embodiments will be apparent in light of the present disclosure.

DETAILED DESCRIPTION

Disclosed is a firearm stock with an adjustable length of pull. In one example embodiment, a firearm stock assembly includes a stock body that defines a longitudinal opening for slidably receiving a beam of a rifle stock. A locking lever positioned below the beam is attached using front and rear pins and can be moved between locked and unlocked positions. The locking lever defines two cam pathways for the front pin. By pivoting the lever downward about the rear pin from the locked position to a first unlocked position, the lever disengages a key from a recess in the beam, allowing for longitudinal adjustment of the stock body along the beam. While pivoted downward, or from the locked position, the user may shift the locking lever forward and down, utilizing a rear cam pathway for the rear pin and an alternate cam pathway for the forward pin. By doing so, the key can be moved further downward and out of engagement with the beam so that the key fully clears the beam and enables the stock body to be removed from the beam. A stock assembly as variously described herein advantageously provides the user with tool-less disassembly.

General Overview

In competitive shooting sports, hunting, law enforcement, and the military, precise shooting is highly desirable, and in some cases, critical. The length of pull is an important adjustment that can make shooting more comfortable and/or more precise. A length of pull that is too long or too short may cause the user's hand and trigger finger to rotate on the grip when firing, therefore causing the user to push or pull the shot.

In some adjustable socks, the stock body is telescopically mounted on a cylindrical tube attached to and extending rearward from the rifle receiver. The user can adjust the position of the stock body using a release lever. After depressing the release lever towards the tube, the user can move the stock body forward or backward along the tube to change the length of pull, which is measured by the distance between the trigger and the proximal end of the buttstock. In addition to intentional adjustments, the lever sometimes can be inadvertently pressed and result in disengaging the locking mechanism. Inadvertent stock adjustment can occur, for example, if the lever is depressed by catching on an object or vegetation. In advertent adjustment can also occur when the shooter is firing with the support hand on the stock, which is common when shooting from a bipod or bench.

Submachine guns, short-barreled rifles, and similar firearms often include a folding stock. Some folding stocks are secured to the firearm using a hinge that engages a mounting rail located on the rear end of the receiver or that is fastened to the rear end of the receiver, for example. The hinge allows the stock to fold between a stowed position and a deployed position. Traditionally, the stock is folded along the left side of the receiver (as viewed by the shooter) when in the stowed position. This stowed position is better suited for right-handed shooters. However, for left-handed shooters, the hinge can be rotated 180°, thereby inverting the beam and changing the direction that the stock folds. As part of inverting the hinge, the stock body must also be removed from the beam and reinstalled so that the stock body is not upside down, a task that requires tools for existing stocks.

Disassembling the stock may need to be performed unexpectedly or in a location where tools are not available. For example, it may be necessary to remove the stock body from the beam if the assembly becomes filled with sand and debris. In such situations, the necessary tools may not be available. Also, even when tools are available, removing the stock from the beam can be time consuming and difficult. Accordingly, a need exists for improvements to adjustable stocks.

The present disclosure addresses these challenges and others by providing a stock with a length-of-pull adjustment and toolless disassembly, in accordance with an embodiment. Additionally, an adjustable stock in accordance with the present disclosure may include a locking mechanism that is not easily actuated when firing, such as when the shooter's support hand is on the stock body. The adjustable stock as variously disclosed herein can be part of a stock assembly that is configured to fold either to the left or right as desired.

Various embodiments of the present disclosure are shown and discussed with reference to a stock body having a skeletonized appearance and a beam that includes a mounting bracket for attachment to the proximal end of a rifle. Note, however, that components of the stock assembly disclosed herein are not limited to the examples shown. Additionally, stock assemblies disclosed herein can be used with any suitable host firearm, such as rifles configured for competitive shooting, hunting, or combat, for example. An adjustable stock in accordance with the present disclosure can be implemented in various rifles, including Sig Sauer's MCX rifles and any other firearm equipped with an adjustable stock. Numerous configurations and embodiments will be apparent in light of this disclosure.

As discussed herein, terms referencing direction, such as upward, downward, vertical, horizontal, left, right, front, back, etc., are used for convenience to describe embodiments of a stock attached to a firearm that has a conventional orientation with the barrel extending horizontally and stock abutting the user's shoulder. Embodiments of the present disclosure are not limited by these directional references and it is contemplated that a stock and its adjustment assemblies could be used in any orientation.

Example Structures

Figure 2:
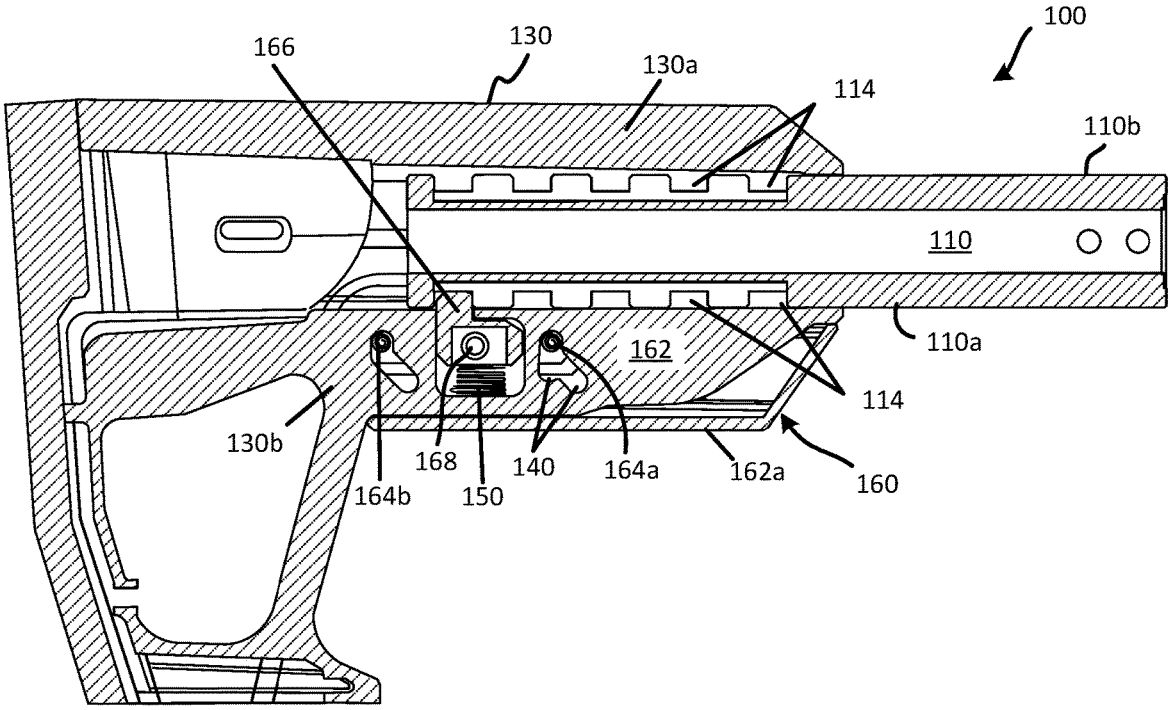
FIG. 2 illustrates a side and cross-sectional view of a stock assembly of FIG. 1 showing components of the locking assembly, in accordance with an embodiment.
Figure 3:
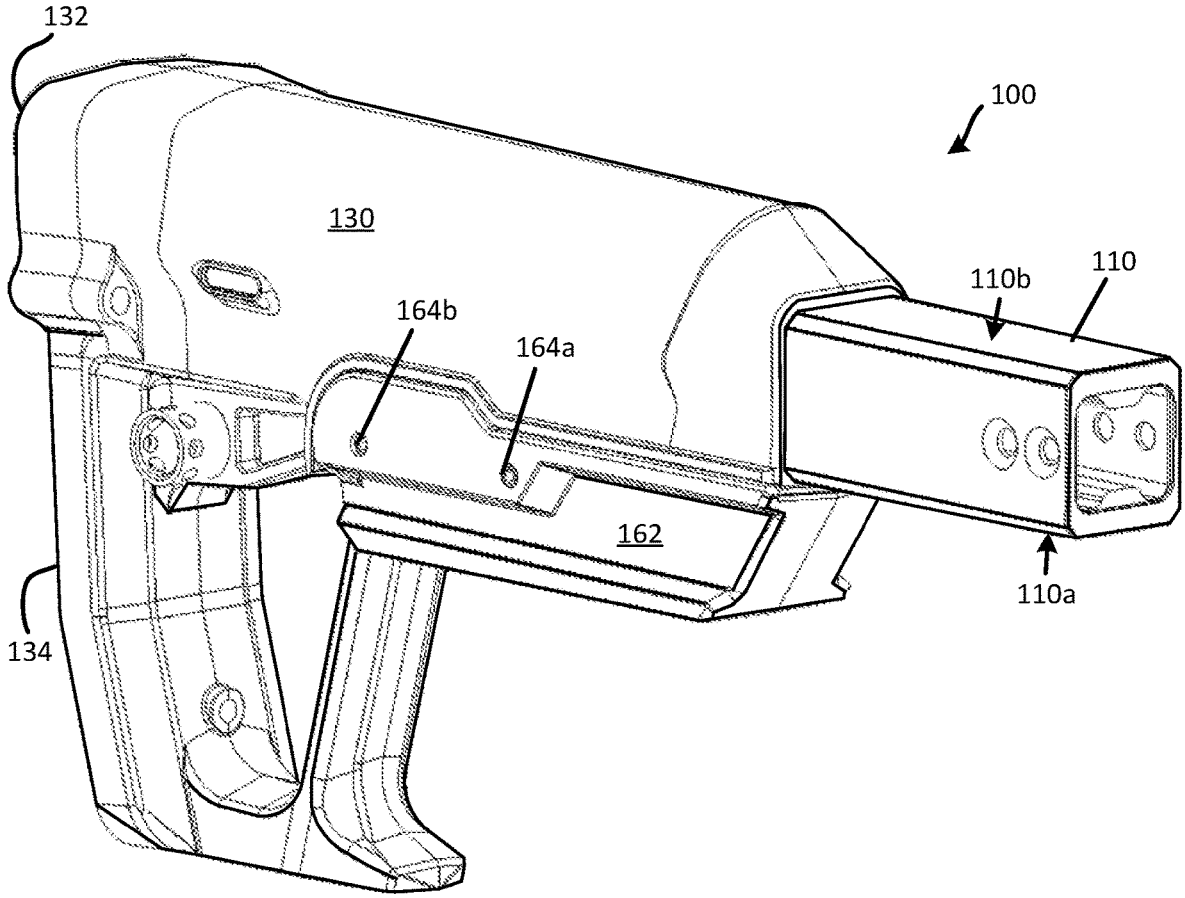
FIG. 3 is a front perspective view of the stock assembly of FIG. 1.
Figure 4:
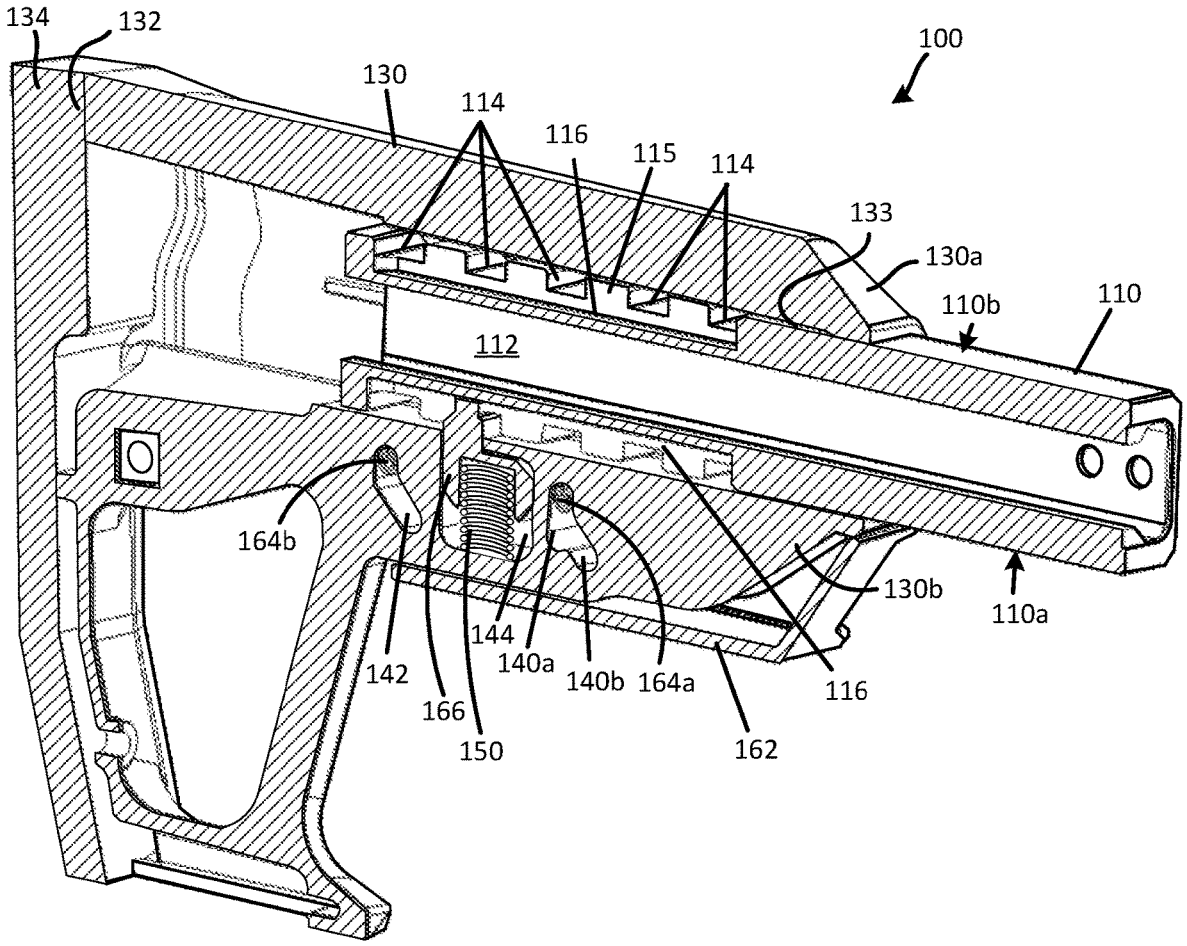
FIG. 4 is a front, perspective, and sectional view of a stock assembly showing the locking mechanism in a locked position, where the section is taken along a longitudinal plane, in accordance with an embodiment of the present disclosure.

FIG. 1 illustrates a side view of a stock assembly 100 with a locking mechanism 160 in a locked position, in accordance with an embodiment of the present disclosure. FIG. 2 illustrates a side and cross-sectional view of the stock assembly 100 of FIG. 1. FIG. 3 is a front perspective view of the stock assembly 100 of FIG. 1 and FIG. 4 is a perspective and cross-sectional view of a stock assembly 100 with the section taken along the median plane, in accordance with an embodiment of the present disclosure. These figures are discussed concurrently below.

The stock assembly 100 includes a beam 110, a stock body 130 movably mounted on the beam 110, and a locking mechanism 160 that is operable between locked and unlocked positions. The locking mechanism 160 includes a lever 162 that is attached with pins to the stock body 130 and that is positioned below the beam 110. From its locked position, the lever 162 can pivot to a first unlocked position or can shift down and forward to a second unlocked position to unlock the locking mechanism 160.

In this example, the beam 110 is a tube of square or rectangular cross-sectional shape. The beam 110 is received in a beam opening 133 that extends longitudinally into the distal end 131 of an upper body portion 130*a* of the stock body 130. In some embodiments, the beam opening 133 extends through to the proximal end 132 of the upper body portion 130*a* where it is closed by a butt plate 134. The beam 110 defines openings or recesses 114 along a proximal end portion 112. For example, the beam 110 includes recesses 114 along both of the top 110*b* and bottom 110*a*, although in some embodiments the beam 110 may define recesses 114 only along the bottom 110*a*. Each recess 114 corresponds to a position of the stock body 130 along the beam 110. A key 166 is operably coupled to the lever 162 by way of posts 168 that extend laterally outward from the key 166 and engage the lever 162. A spring 150 between the key 166 and the stock body 130 biases the key 166 into engagement with the beam 110 and also biases the lever 162 to the closed position along the bottom of the beam 110. In this example, the stock body 130 defines a void 144 below the beam 110 that receives the key 166 and spring 150.

When the user pulls down on the front portion 162*a* of the lever 162, the lever 162 can pivot about the rear pin 164*b* while the front pin 164*a* moves downward along a first forward cam pathway 140*a* defined in the stock body 130. The first forward cam pathway 140*a* generally follows a vertical path through a lower body portion 130*b* of the stock body 130. At the same time, this pivot action draws the key 166 out of engagement with one of the recesses 114 and allows longitudinal adjustment of the stock body 130 along the beam 110. In this first unlocked position, a boss 165 on the key 166 remains partially within a clearance channel 116 that extends longitudinally along the proximal end portion 112 of the beam 110. In this configuration, the user can adjust the position of the stock 130 along the beam, but the boss 165 blocks removal of the stock 130 from the beam 110. When the user releases the lever 162, the spring 150 returns the lever 162 towards the bottom of the beam 110 and returns the key 166 to engage the beam 110 (e.g., occupy a recess 114).

Alternately, the lever 162 as a whole can be pulled down and forward (e.g., translated) so that the rear pin 164*b* follows the rear cam pathway 142 and the front pin 164*a* follows the second forward cam pathway 140*b*, both of which follow a downward and forward path. In this example, the rear cam pathway 142 and the second forward cam pathway 140*b* both include a downward segment and a down and forward segment. In other embodiments, the rear cam pathway 142 and the second forward cam pathway 140*b* may be curved or follow a linear diagonal path. When the lever is shifted or translated downward and forward, the key 166 is moved further downward and out of engagement with the beam 110 so that the boss 165 clears the beam 110 completely and the stock body 130 can be slidably removed from the beam 110. The downward and forward translational movement of the lever 162 is generally contrary to movements encountered during ordinary use of the rifle and therefore is unlikely to result in inadvertent movement of the lever 162 to the second unlocked position. The forward and downward movement of the lever 162 is also unlikely to occur in the event that the lever 162 snags on vegetation or clothing; accordingly, such an event is unlikely to result in the lever 162 being inadvertently moved to the second unlocked position.

Figure 5:
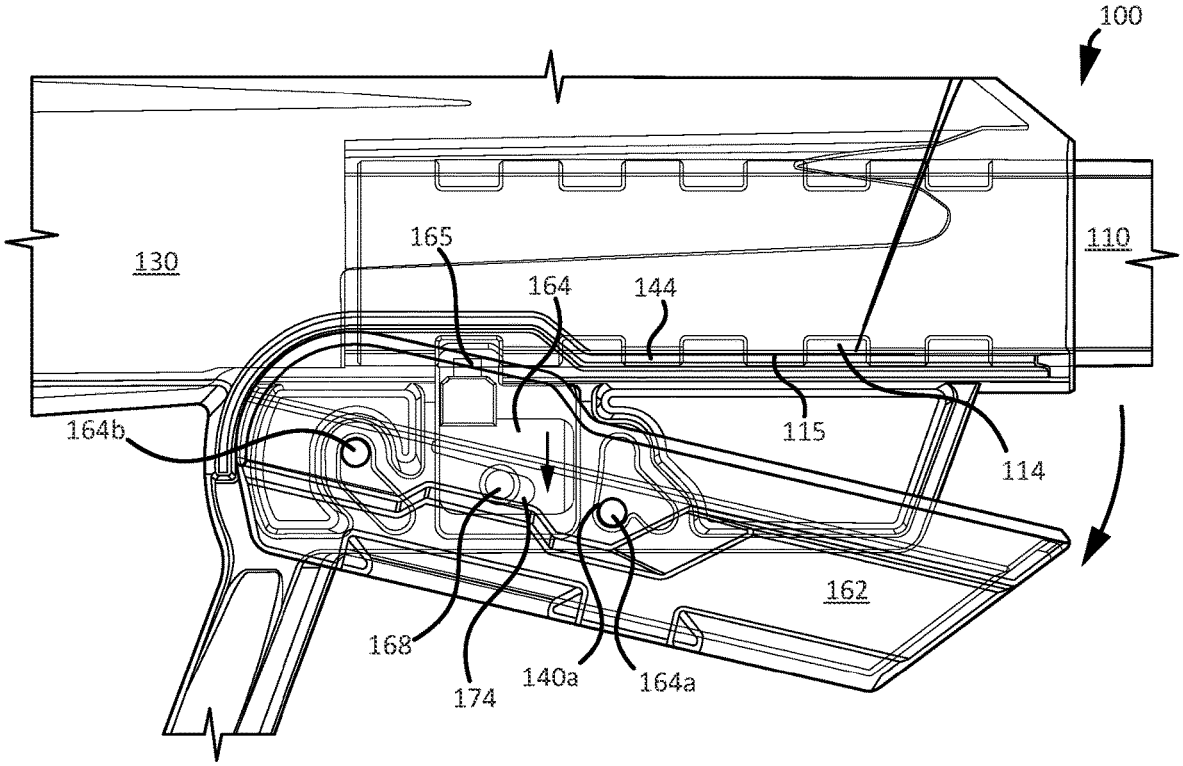
FIG. 5 illustrates a transparent side view of part of a stock assembly showing the lever moved to a first unlocked position in which the position of the stock body can be moved along the beam, in accordance with an embodiment of the present disclosure.

FIG. 5 illustrates a transparent side view of a stock assembly 100 with the lever 162 of the locking mechanism 160 moved to a first unlocked position, in accordance with an embodiment of the present disclosure. Note that the spring 150 is not shown in this example. In the first unlocked position, the stock body 130 can move longitudinally along the beam 110 but is blocked by the boss 165 from moving off the end of the beam 110. In this example, the lever 162 has pivoted downward about the rear pin 164*b*, causing the key 166 to translate vertically downward and disengage from the recess 114 along the bottom of the beam 110. As the key 166 translates downward within the void 144, the lateral posts 168 on the key 166 moves within a slot 146 defined along inside faces of the lever 162. The front pin 164*a* is now at or near the bottom of the first forward cam pathway 140*a*. In this first unlocked position, note that the key 166 is clear of the lands 115 and can travel longitudinally along the beam 110 with the boss 165 in the clearance channel 116. Thus, the stock body 130 can be moved to any one of the positions defined by the recesses 114. However, when the locking mechanism 160 is in the first unlocked position, the boss 165 does not clear the entire beam 110 and therefore does not permit the stock body 130 to be removed from the beam 110.

Figure 6:
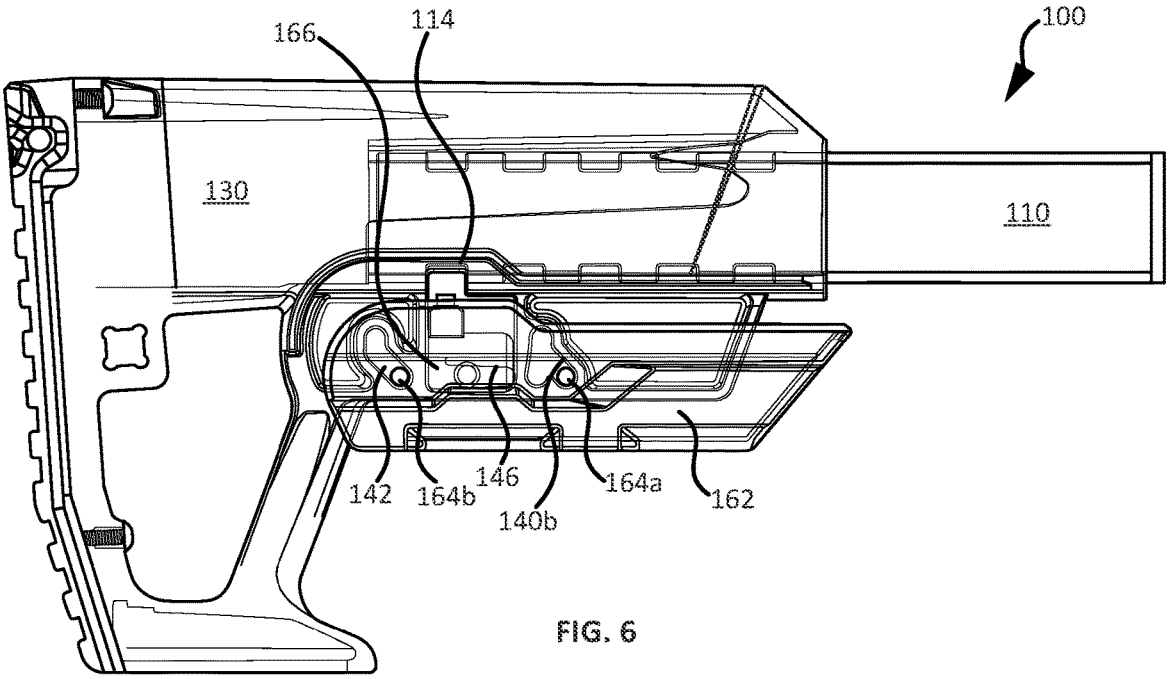
FIG. 6 illustrates a transparent side view showing part of a stock assembly with the lever moved to a second unlocked position in which the stock body can be removed from the beam, in accordance with an embodiment of the present disclosure.

Referring now to FIG. 6, a transparent side view shows the locking mechanism 160 of a stock assembly 100 in a second unlocked position, in accordance with an embodiment of the present disclosure. Note that the spring 150 is not shown in this example. In the second unlocked position, the stock body 130 can be removed from the beam 110. As shown here, the lever 162 has moved downward and forward so that the front pin 164*a* has followed the second forward cam pathway 140*b* and the rear pin 164*b* has followed the rear cam pathway 142. Stated differently, the lever 162 has translated or shifted downward and forward with respect to the stock body 130. In doing so, the key 166 has been drawn downward in the void 144 to a greater extent that in the first unlocked position such that the key 166 is disengaged from the recess 114 and completely clears the beam 110. As such, the stock body 130 can be slidably removed from the beam 110. Note that in this second unlocked position that the lever 162 and slot 146 have a horizontal orientation that is generally parallel to the orientation of the lever 162 when in the locked position; this is not required in all embodiments.

Figure 7A:
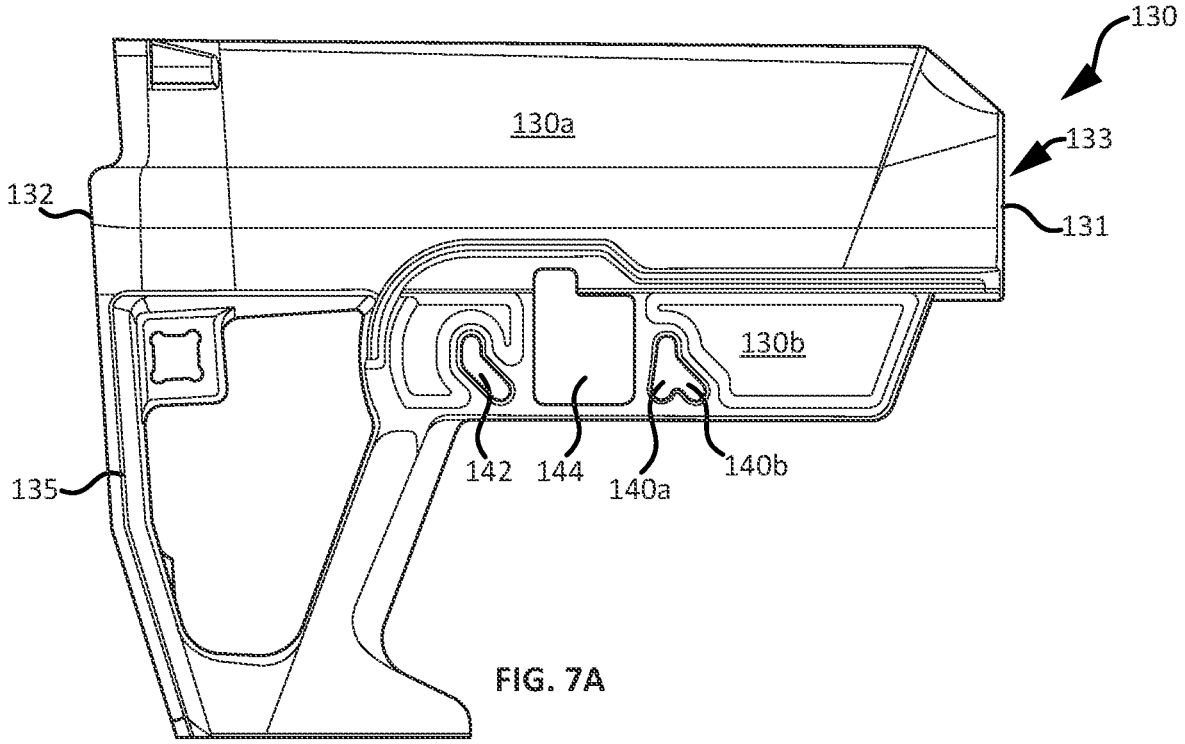
FIGS. 7A and 7B illustrate a side view and a front perspective view, respectively, of a stock body, in accordance with an embodiment of the present disclosure.
Figure 7B:
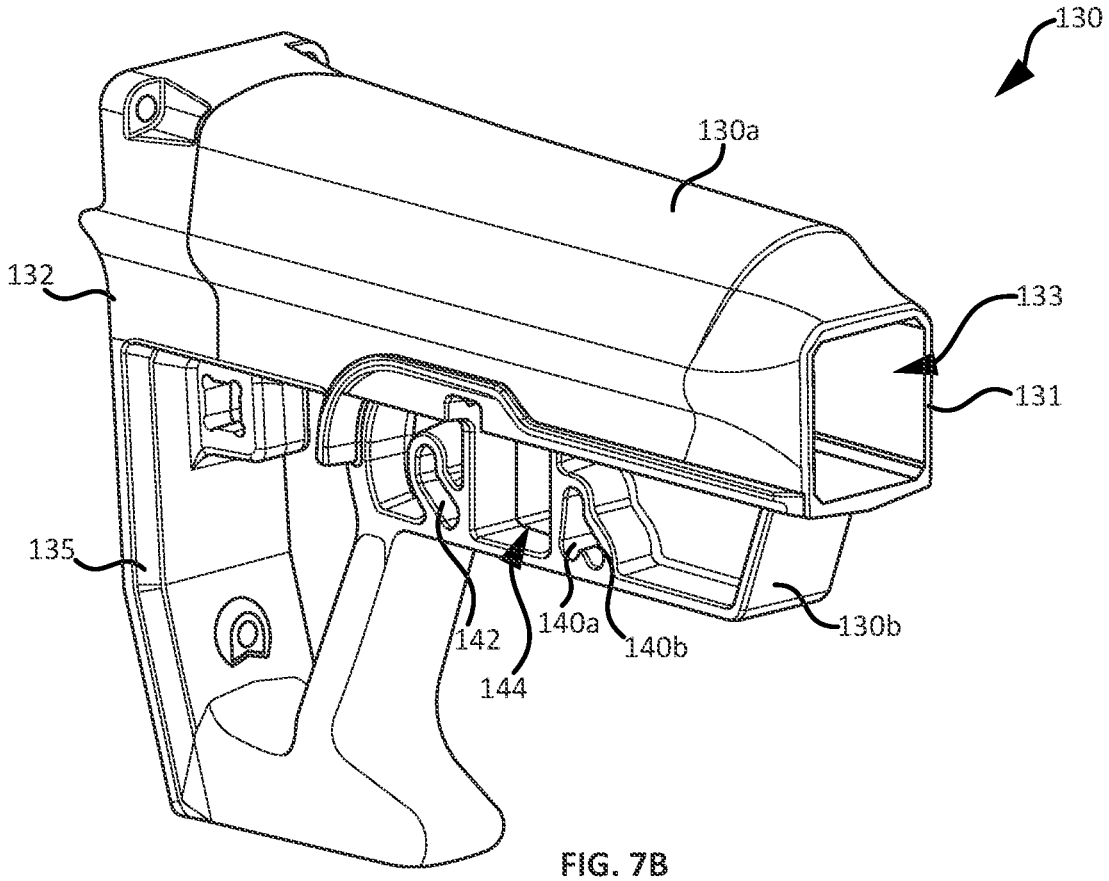

FIGS. 7A and 7B illustrate a side view and a front perspective view, respectively, showing a stock body 130, in accordance with an embodiment of the present disclosure. In this example, the stock body 130 includes an upper body portion 130*a* and a lower body portion 130*b* that are part of a single, monolithic structure. The upper body portion 130*a* generally has a hollow tubular geometry that defines a beam opening 133 extending longitudinally into the stock body through a distal end 131. The upper body portion 130*a* can define a cheek rest, comb, or other feature as needed or as desired.

The beam opening 133 can have a cross-sectional shape that corresponds the cross-sectional shape of the beam 110 to be received; however, this is not required in all embodiments. In this example, the beam opening 133 is generally rectangular with chamfered inside corners for receiving a beam 110 of corresponding geometry. In other embodiments, the beam opening 133 may be square or rectangular and the beam 110 may have a hexagonal, octagonal, or other geometry that is compatible with the geometry of the beam opening 133. The beam opening 133 can extend completely or partially through the stock body 130. As shown in FIG. 4, for example, the beam opening 133 can extend completely through the stock body 130. In such embodiments, the beam opening 133 can be closed at the proximal end 132 of the stock body 130 by a butt plate 134 that is removably attached to the stock body 130 using fasteners, an interference fit, or other suitable mechanism. In other embodiments, the beam opening 133 extends only part way into the stock body 130, such as when the butt plate 134 is integrally formed as part of the stock body 130. Numerous variations and embodiments will be apparent in light of the present disclosure.

The lower body portion 130*b* of the stock body 130 is below the beam opening 133 and includes a support 135 for part of the butt plate 134. The support 135 can be configured to include a handle and/or strap loop in some embodiments. The lower body portion 130*b* defines the void 144 that houses the spring 150 and part of the key 166 (shown, e.g., in FIG. 4). The top of the void 144 is open to the beam opening 133 for a portion of the key 166. The lower body portion 130*b* also defines the rear cam pathway 142 behind and spaced from the void 144, and further defines the first and second forward cam pathways 140*a*, 140*b* in front of the void 144. The rear cam pathway 142, first forward cam pathway 140*a*, and second forward cam pathway 140*b* are through-openings that extend laterally through the lower body portion 130*b* to accommodate pins 164 that extend laterally between opposite sides of the lever 162. The void 144 is illustrated as a through-opening, but this is not required in all embodiments.

Figure 8A:
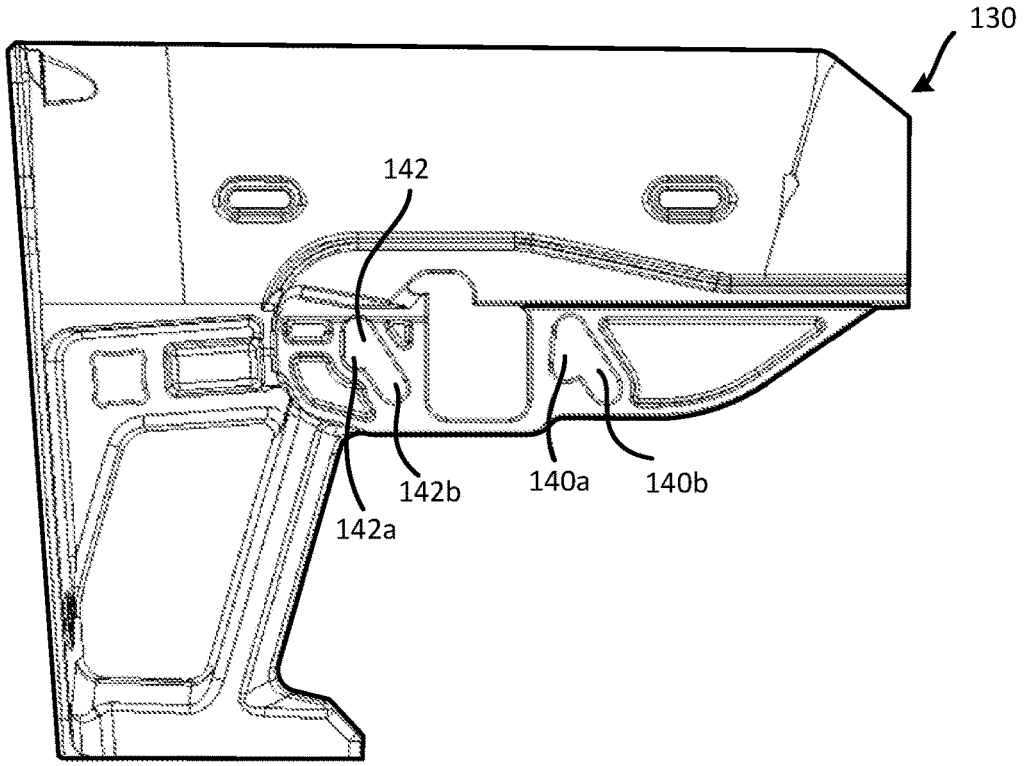
FIGS. 8A and 8B illustrate a side view and a front perspective view, respectively, of a stock body, in accordance with another embodiment of the present disclosure
Figure 8B:
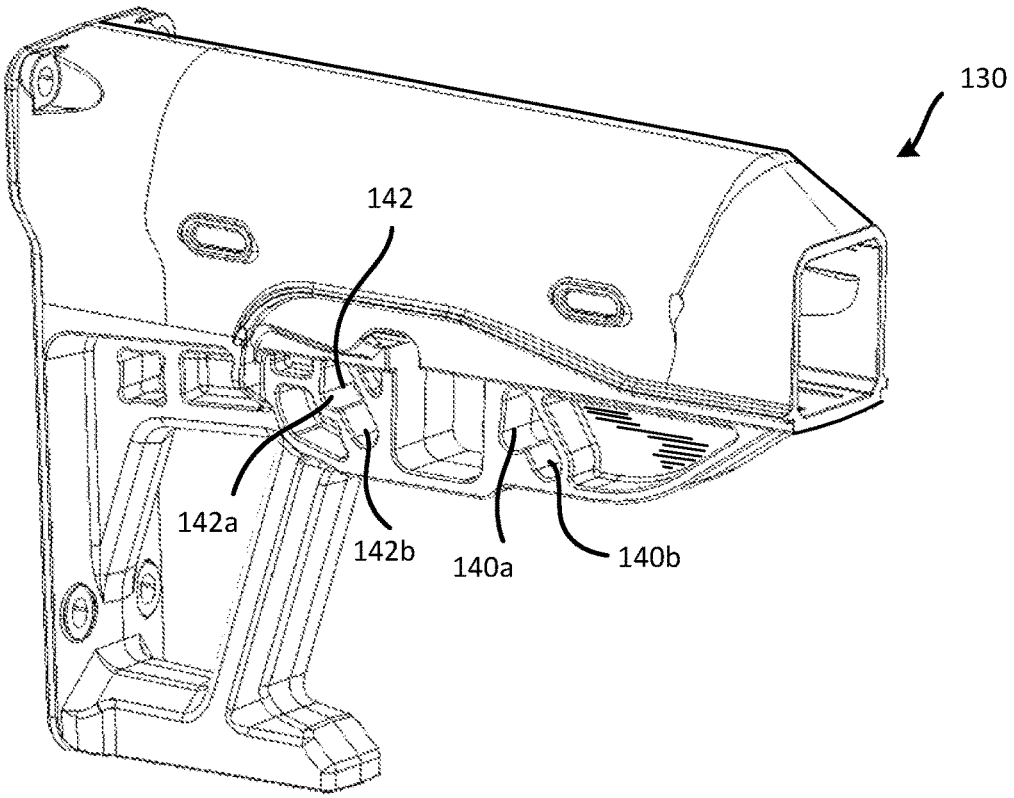

FIGS. 8A and 8B illustrate a side view and a front perspective view, respectively, showing a stock body 130, in accordance with another embodiment of the present disclosure. In this example, the rear cam pathway 142 includes a first rear cam pathway 142*a* extending downward and forward along a generally linear path. The rear cam pathway 142 also includes a second rear cam pathway 142*b* that follows a downward path. For example, the second rear cam pathway 142*b* extends along a linear path generally in a vertical direction and intersects the first rear cam pathway 142*a* at its top. The second rear cam pathway 142*b* can have a shorter vertical dimension (e.g., ~50%, ~60%, ~70%, ~80%) of the vertical dimension of the first rear cam pathway 142*a*. The bottom of the second rear cam pathway 142*b* defines a stop that prevents or reduces the likelihood of inadvertently moving the lever 162 downward and forward to the second unlocked position. When the rear pin 164*b* engages the bottom of the second rear cam pathway 142*b*, for example, the lever 162 remains in the first unlocked position and requires additional movement to move to the second unlocked position. For example, the user may shift the lever 162 forward to enter the first rearward cam pathway 142*a* and then diagonally downward and forward along the remainder of the first rearward cam pathway 142*a* to the second unlocked position. Thus, in accordance with some embodiments, including the second rear cam pathway 142*b* necessitates a higher degree of intentional movement in order to move the lever 162 to the second unlocked position, thereby reducing the occurrence of inadvertently removing the stock body 130 from the beam 110.

Figure 9A:
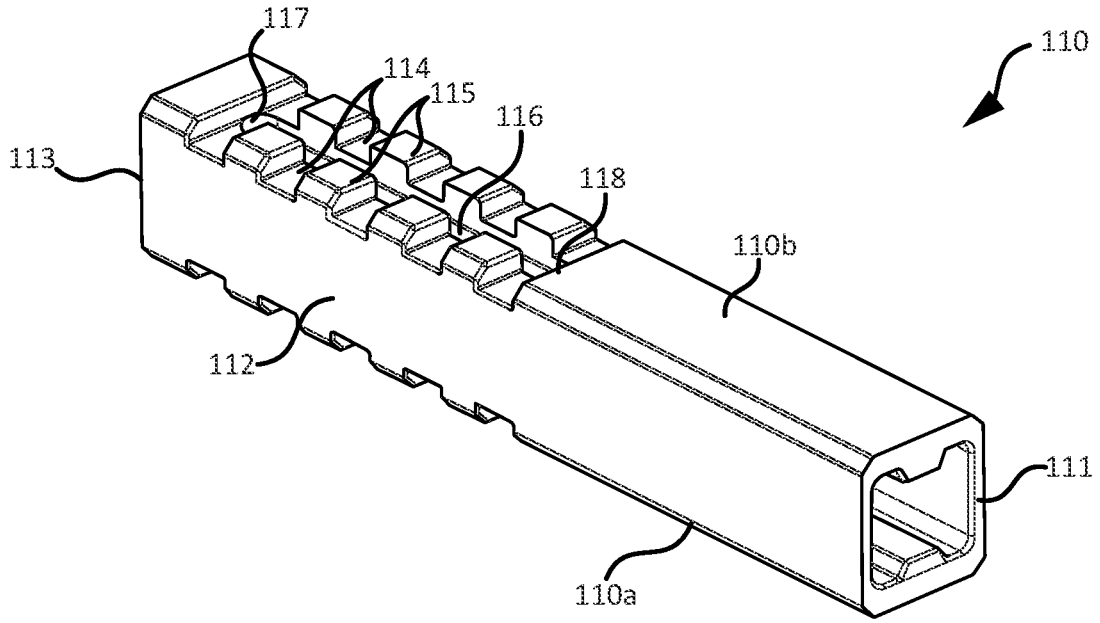
FIGS. 9A and 9B illustrate a top and front perspective view and a top and rear perspective view, respectively, of a beam, in accordance with an embodiment of the present disclosure.
Figure 9B:
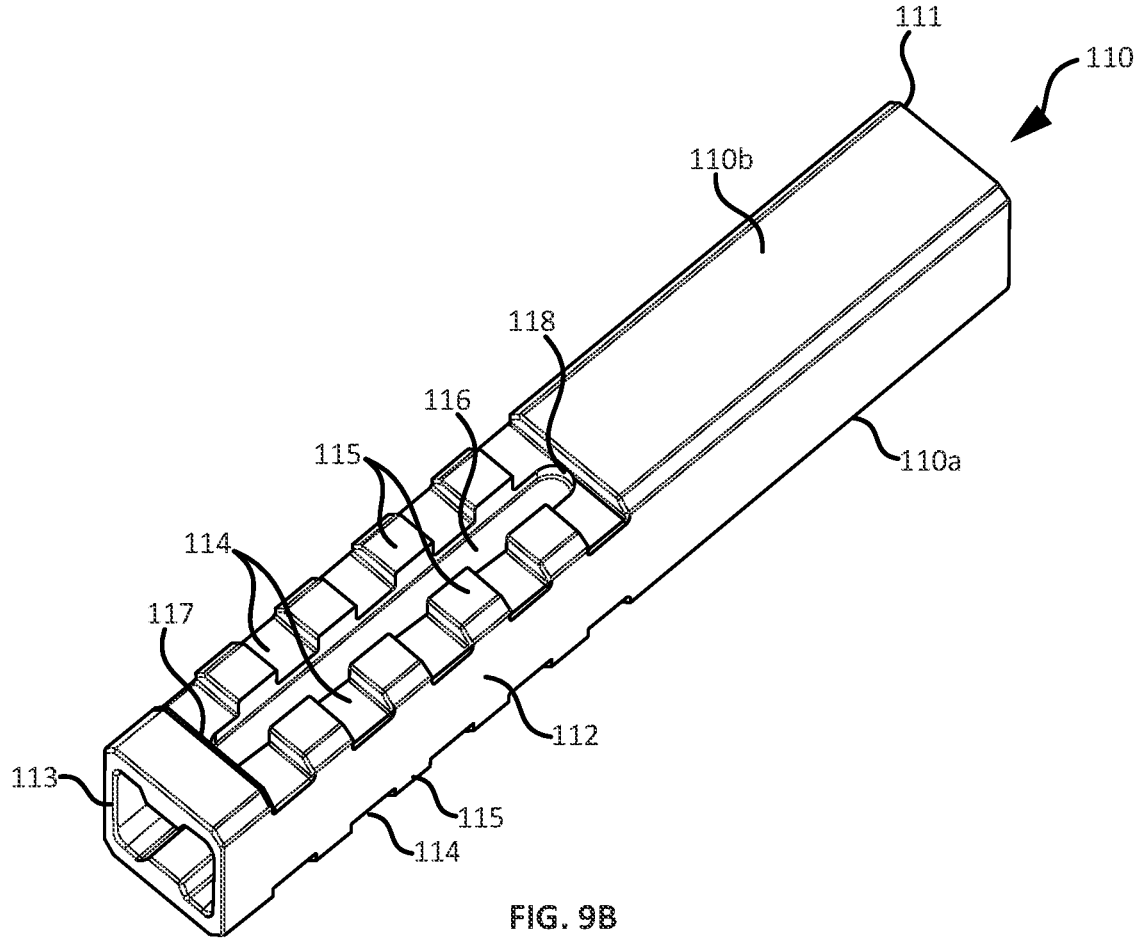

FIGS. 9A and 9B illustrate a top and front perspective view and a top and rear perspective view, respectively, of a beam 110, in accordance with an embodiment of the present disclosure. In this example, the beam 110 extends longitudinally from a distal end 111 to a proximal end 113 and generally has a hollow square or rectangular cross-sectional shape with chamfered outside corners. The beam 110 can be hollow to reduce mass, but it can be solid along all or part of its length, except for fastener openings where needed. The beam 110 is symmetrical top to bottom and left to right in this example but this feature is not required. The proximal end portion 112 of the beam 110 defines a plurality of alternating lands 115 and recesses 114 in the top face 110*b* and bottom face 110*a*. The recesses 114 are spaced by lands 115 and define corresponding positions for the stock body 130. The proximal end portion 112 also defines a clearance channel 116 that extends longitudinally and intersects the lands 115 and recesses 114. The clearance channel 116 extends into each of the top and bottom faces 110*b*, 110*a* to a greater depth than recesses 114, and is sized to receive the boss 165 on the key 166. In this example, the clearance channel 116 is centrally located, but the clearance channel 116 can have other lateral positions on the beam 110 as appropriate for the corresponding geometry of the key 166, such as extending along one or both sides of the lands 115. During longitudinal adjustment of the stock body 130 with the lever 162 in the first unlocked position, the boss 165 is received in and can travel along the clearance channel 116. At the same time, other portions of the key 166 (e.g. the transverse block 174) are retracted from the recesses 114 and clear the lands 115 to permit the stock body 130 to move along the beam 110. Note that the clearance channel 116 terminates short of the proximal end 113 so as to define a rear stop 117 that engages the boss 165 and prevents the stock body 130 from sliding off the proximal end 113 of the beam 110 when the lever 162 is in the first unlocked position. Similarly, the clearance channel 116 and recesses 114 are only present along the proximal end portion 112 (or otherwise stop short of the distal end 111), thereby defining a forward stop 118 for the stock body 130.

Figure 10A:
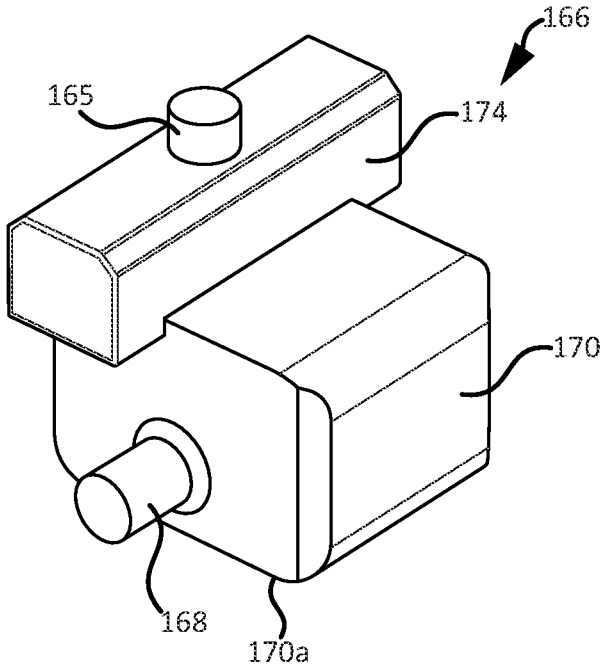
FIGS. 10A and 10B illustrate top and bottom perspective views, respectively, of a key of a locking mechanism for a stock assembly, in accordance with an embodiment of the present disclosure.
Figure 10B:
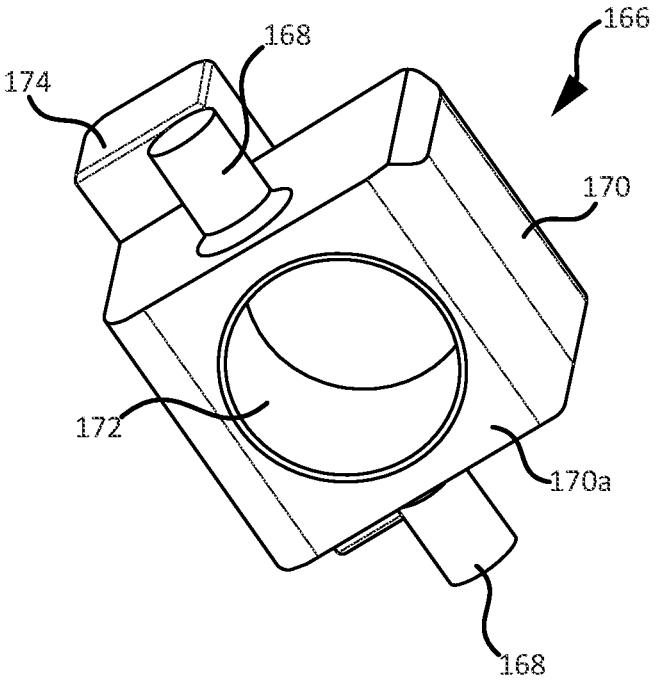

FIGS. 10A and 10B illustrate a top and front perspective view and a bottom perspective view, respectively, of a key 166 provided as part of a locking mechanism 160 for a stock assembly 100, in accordance with an embodiment of the present disclosure. The key 166 includes a key body that is sized and configured to be retained in the void 144 in the stock body 130 and to translate vertically within the void 144 in response to movement of the lever 162. In the example shown, the key body 170 has a cuboid shape approximating a cube and includes rounded corners. The front and rear upper and lower corners are rounded to facilitate smooth sliding movement of key body 170 in the void 144. The key body 170 defines a spring pocket 172 extending upward into the key body 170 through the bottom face 170*a*. The spring pocket 172 is a blind bore in this example; other geometries are acceptable, depending at least in part on the geometry of the spring 150, as will be appreciated. Posts 168 extend laterally from each side of the key body 170 and are sized to be received in the corresponding slot 146 in the sides of the lever 162. The posts 168 are coaxially arranged and extend from opposite side faces of the key body 170. In other embodiments, posts 168 can be replaced by a pin extending through the key body 170, where the pin is located so as not to frustrate the action of the spring 150, which is received in the spring pocket 172. For example, the pin can be located above the spring pocket 172 or some other suitable location.

A transverse block 174 is on the top of the key body 170 and extends laterally outwardly therefrom. The transverse block 174 is configured to be received in each of the recesses 114 defined on the beam 110. As noted above, when the locking mechanism 160 is in the locked condition, the transverse block 174 occupies one of the recesses 114. When the locking mechanism 160 is in the first or second locked condition, the transverse block is translated downward into the void 144 and out of the recess 114.

A boss 165 extends upwardly from a top of the transverse block 174. In the example shown, the boss 165 has a cylindrical shape and is centrally located on a top surface of the transverse block 174. Other geometries and suitable locations can be used, provided that the boss 165 remains configured to travel in the clearance channel 116 and move between locked and unlocked conditions with respect to the beam, as discussed above. For example, the boss 165 can have a rectangular block shape oriented along the central axis of the beam 110, a hexagonal cross-sectional shape, or other geometries.

Figure 11A:
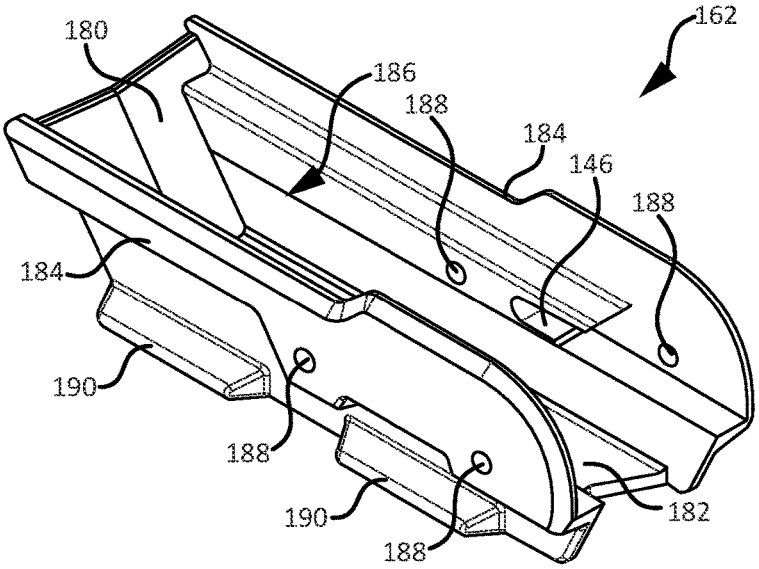
FIGS. 11A and 11B illustrate a top, side, and rear perspective view and a side elevational view, respectively, of a lever of a stock assembly, in accordance with an embodiment of the present disclosure.
Figure 11B:
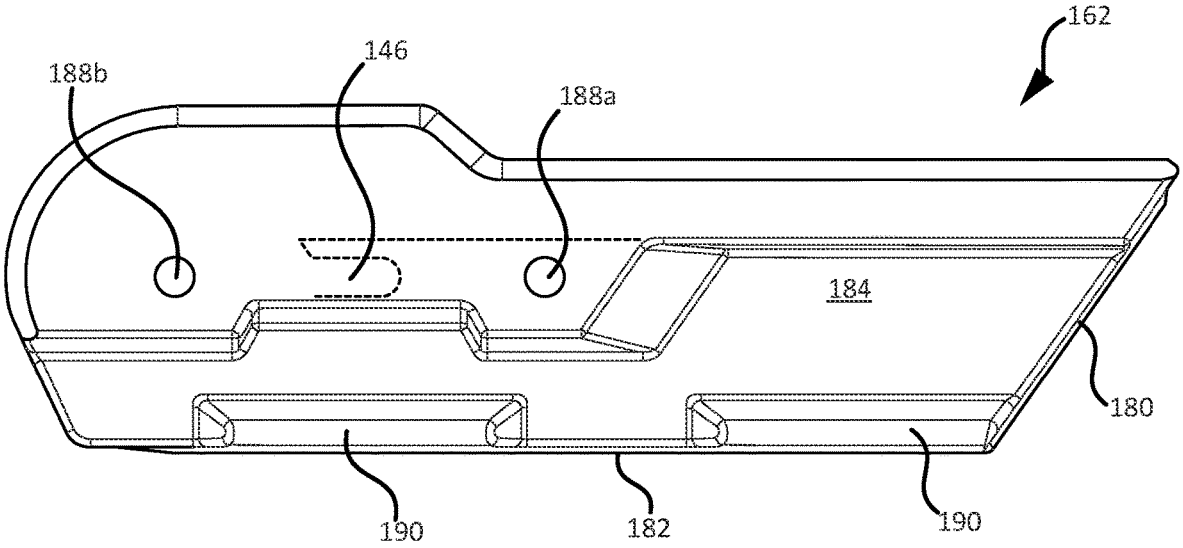

FIGS. 11A and 11B illustrate a top, side, and rear perspective view, and a side elevational view, respectively, of a lever 162 of a stock assembly 100, in accordance with an embodiment of the present disclosure. In this example embodiment, the lever 162 has a bottom wall 182, a front wall 180, and spaced-apart side walls 184 that define an open region 186 shaped to receive the lower body portion 130*b* of the stock body 130. Each side wall 184 defines a slot 146 to receive the corresponding post 168 extending from the key body 170. Each side wall 184 also defines pin openings 188, each configured to receive one of the pins 164. Outside faces of each side wall 184 define a protrusion or other gripping feature configured to facilitate the user operating the lever 162. Other geometries can be used, as will be appreciated.

Figure 12A:
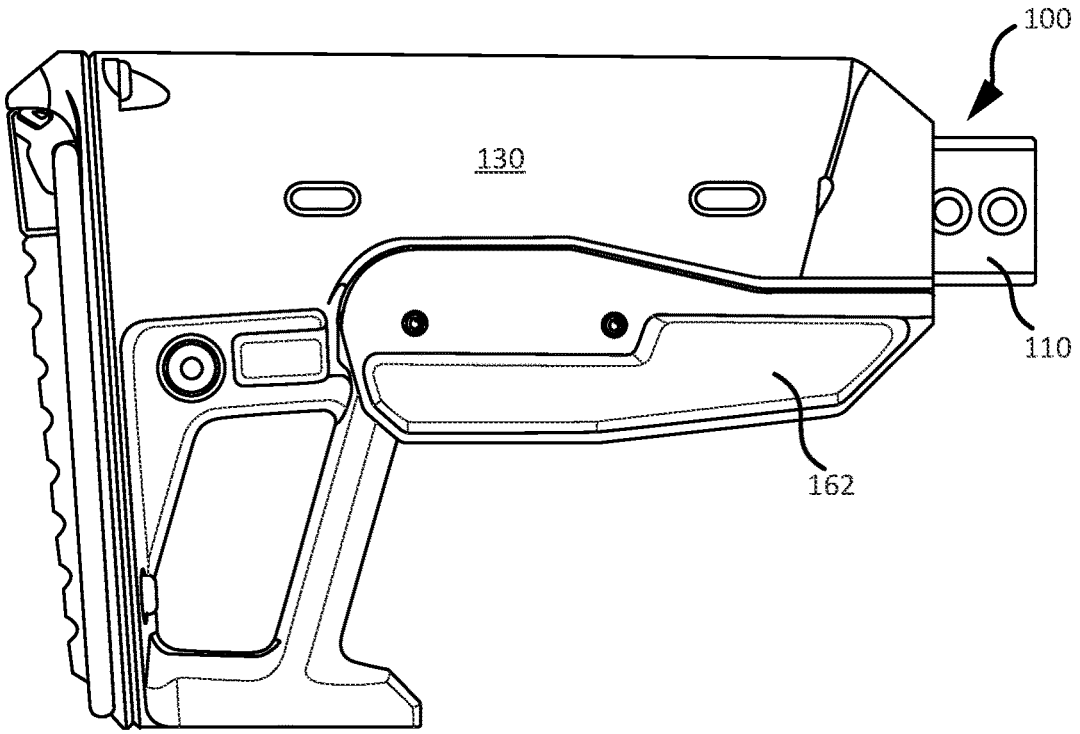
FIG. 12A illustrates a side view showing a stock assembly with a lever in a locked position, in accordance with an embodiment of the present disclosure.
Figure 12B:
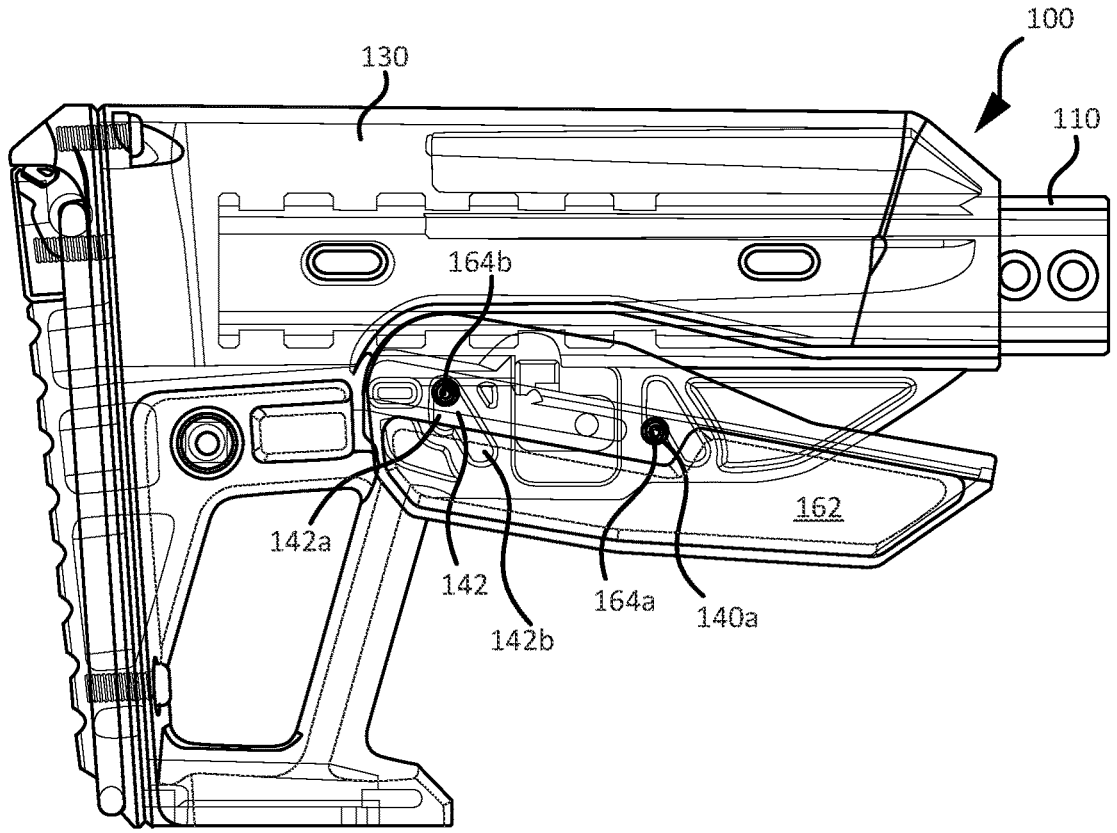
FIG. 12B illustrates a side view showing a stock assembly with a lever in a first unlocked position, in accordance with an embodiment of the present disclosure.
Figure 12C:
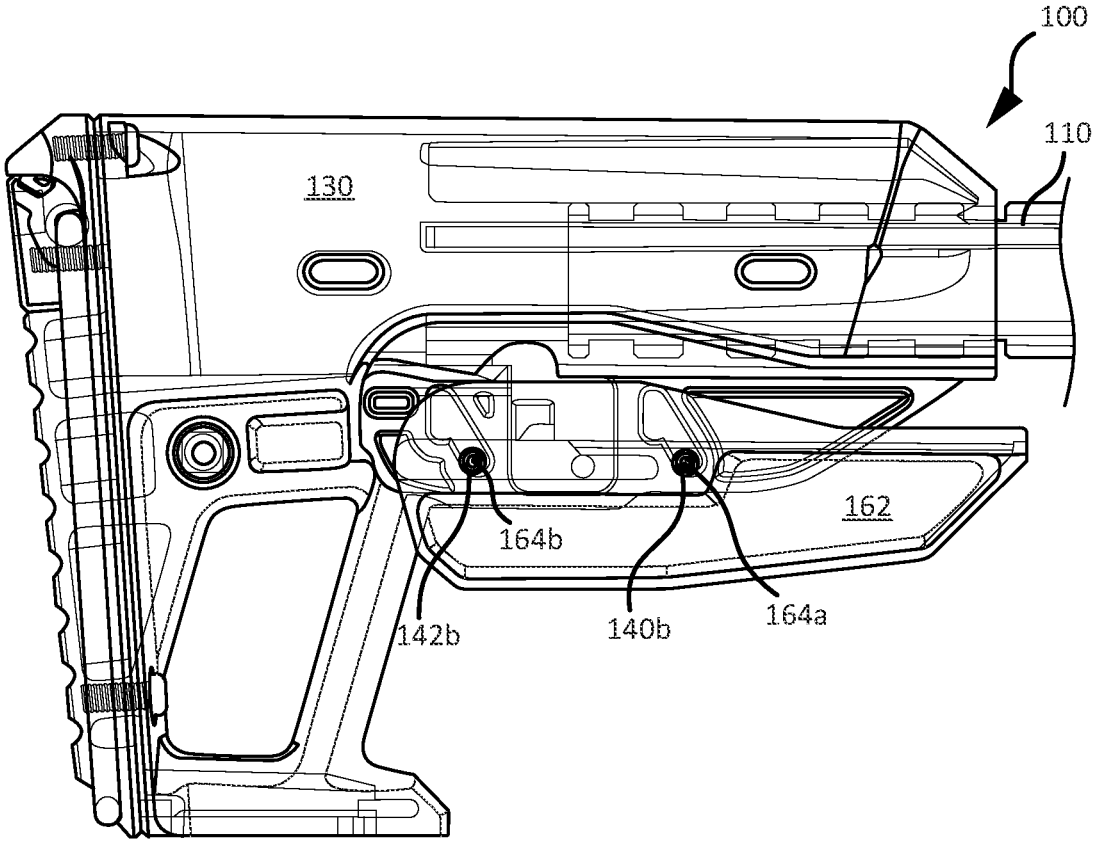
FIG. 12C illustrates a side view showing a stock assembly with a lever in a second unlocked position, in accordance with an embodiment of the present disclosure.

FIG. 12A illustrates a side view showing a stock assembly 100 with the lever 162 in a locked position, in accordance with another embodiment of the present disclosure. FIG. 12B illustrates a side view showing the stock assembly of FIG. 12A with the lever 162 in a first unlocked position. FIG. 12C illustrates a side view showing the stock assembly 100 of FIG. 12A with the lever 162 in a second unlocked position. Components of the stock assembly 100 are shown transparent in FIGS. 12B-12C to better show the location of the front pin 164*a* in the first cam pathway 140*a* or second cam pathway 140*b*, and the location of the rear pin 164*b* in the first rear cam pathway 142*a* or the second rear cam pathway 142*b*.

In FIG. 12B, the front pin 164*a* occupies the bottom of the first cam pathway 140*a* and the rear pin 164*b* occupies the top of the rear cam pathway 142 in an intersection of the first and second rear cam pathways 142*a*, 142*b*. In this position, the lever 162 has been pivoted to the first unlocked position, allowing longitudinal adjustment of the stock body 130 along the beam 110. In FIG. 12C, the front pin 164*a* occupies the bottom of the second cam pathway 140*b* and the rear pin 164*b* occupies the bottom of the second rear cam pathway 142*b*. In this position, the lever 162 has been moved downward and forward to the second unlocked position, allowing the stock body 130 to be removed from the beam 110 if desired.

As noted above, the lever 162 is attached to the stock body 130 by a rear pin 164*b* that extends through a rear pin opening 188*b* and a front pin 164*a* that extends through a front pin opening 188*a* (shown in FIG. 11B). Lever 162 is configured to be operated by a user to pivot about the rear pin 164*b* to a first unlocked position. The lever 162 also can shift or translate downward and forward to a second unlocked position. Moving the lever 162 to either of the first or second unlocked positions translates the key 166 downward in the void 144. It is contemplated within the scope of the present disclosure that other lever configurations can be utilized to accomplish these actions and the lever 162 is not limited to the particular geometry disclosed herein. Numerous variations and embodiments will be apparent in light of the present disclosure.

Further Example Embodiments

The following examples pertain to further embodiments, from which numerous permutations and configurations will be apparent.

Example 1 is an adjustable firearm stock comprising a beam extending longitudinally along a beam axis, the beam defining a plurality of recesses and a clearance channel along a bottom surface, the clearance channel extending into the beam to a depth that is greater than a depth of the plurality of recesses; a stock body having an upper body portion and a lower body portion, the upper body portion defining a beam opening sized and shaped to slidingly receive a portion of the beam, the lower body portion defining a rear cam pathway and a forward cam pathway with first and second portions; a lever attached to the stock body with a first pin in the rear cam pathway and a second pin in the forward cam pathway, wherein the lever is pivotable between a locked position and a first unlocked position, and wherein the lever is translatable between the locked position and a second unlocked position; and a locking mechanism between the lever and the beam, the locking mechanism operable between locked and unlocked conditions in response to movement of the lever among the locked position, the first unlocked position, and the second unlocked position; wherein when the lever is in the locked position the locking mechanism fixes a longitudinal position of the stock body on the beam; wherein when the lever is in the first unlocked position, the locking mechanism permits longitudinal adjustment of the stock body along the beam; and wherein when the lever is in the second unlocked position the locking mechanism permits the stock body to be slidably removed from the beam.

Example 2 includes the subject matter of Example 1, wherein the locking mechanism includes a key and a spring, wherein the spring biases the key towards engagement with the beam.

Example 3 includes the subject matter of Example 2, wherein the lower body portion of the stock body defines a void between the rear cam pathway and a forward cam pathway, wherein the key is at least partially housed in the void and the spring is between the lower body portion and a bottom of the key.

Example 4 includes the subject matter of Example 3, wherein the key is housed in the void.

Example 5 includes the subject matter of any one of Examples 3-4, wherein the key defines a spring recess, wherein the spring is at least partially housed in the spring recess.

Example 6 includes the subject matter of any one of Examples 2-5, wherein (i) the key includes a key body, a transverse block on a top of the key body, and a boss on top of the transverse block; (ii) when the lever is in the locked position the transverse block is received in one of the plurality of recesses and the boss is received in the clearance channel; (iii) when the lever is in the first unlocked position the transverse block is in a clearance position with respect to the beam; and (iv) when the lever is the second unlocked position the boss and the transverse block are in a clearance position with respect to the beam.

Example 7 includes the subject matter of any one of Examples 1-6, wherein the plurality of recesses and the clearance channel are defined along a proximal end portion of the beam.

Example 8 includes the subject matter of any one of Examples 1-7, wherein the beam further defines a second plurality of recesses and a second clearance channel along a top surface, the second clearance channel extending into the beam to a depth that is greater than a depth of the second plurality of recesses.

Example 9 includes the subject matter of any one of Examples 1-8, wherein the beam generally has a rectangular cross-sectional shape.

Example 10 includes the subject matter of any one of Examples 1-8, wherein the beam comprises a cylindrical body and a rectangular portion attached to and extending longitudinally along part of a bottom of the cylindrical body, where the rectangular portion defines the plurality of recesses. In one such embodiment, the beam can be or is modeled after a traditional M4 carbine buffer tube.

Example 11 includes the subject matter of any one of Examples 1-10, wherein the lever defines an open region between a bottom wall, a first sidewall, and a second sidewall spaced apart from the first sidewall, and wherein part of the lower body portion is received in the open region when the lever is in the locked position.

Example 12 includes the subject matter of Example 11, wherein the key further comprises posts extending laterally outward from opposite sides of the key body, wherein an inside surface of each of the first and second sidewalls defines a slot, and wherein each post is received in the slot of the respective first or second sidewall of the lever.

Example 13 includes the subject matter of any one of Examples 11-12, further comprising protrusions extending laterally outward from the first and second sidewalls.

Example 14 includes the subject matter of any one of Examples 1-13, wherein the rear cam pathway and the second portion of the forward cam pathway each have a first leg extending downward and a second leg extending downward and forward.

Example 15 includes the subject matter of any one of Examples 1-14, further comprising a butt plate removably attached to a proximal end of the stock body.

Example 16 is a firearm comprising the adjustable firearm stock of any one of Examples 1-15.

Example 17 includes the subject matter of Example 16, wherein the firearm is selected from a rifle, a machine gun, a short-barreled rifle, and a pistol.

Example 18 is a method of adjusting a firearm stock, the method comprising: providing an adjustable rifle stock comprising a beam extending longitudinally along a beam axis, the beam defining a plurality of recesses and a clearance channel along a bottom surface, the clearance channel extending into the beam to a depth that is greater than a depth of the plurality of recesses; a stock body having an upper body portion and a lower body portion, the upper body portion defining a beam opening sized and shaped to slidingly receive a portion of the beam; a lever attached to the stock body below the upper body portion, the lever pivotable between a locked position and a first unlocked position, and movable between the locked position and a second unlocked position; and a locking mechanism between the lever and the beam, the locking mechanism operable between locked and unlocked conditions in response to movement of the lever among the locked position, the first unlocked position, and the second unlocked position; shifting the lever downward and forward with respect to the beam, thereby moving the locking mechanism to the second unlocked position; and sliding the stock body off of the beam.

Example 19 includes the subject matter of Example 18, where shifting the lever downward and forward includes first translating the lever downward and then translating the lever forward and downward.

Example 20 includes the subject matter of Example 18 or 19 and further comprises pivoting the lever to the first unlocked position, thereby moving the locking mechanism to the first unlocked position.

Example 21 is a method of adjusting a firearm stock, the method comprising providing the adjustable firearm stock of any one of Examples 1-15; shifting the lever downward and forward with respect to the beam, thereby moving the locking mechanism to the second unlocked position; and then sliding the stock body off of the beam.

Example 22 includes the subject matter of Example 21, where shifting the lever downward and forward includes first translating the lever downward and then translating the lever forward and downward.

Example 23 includes the subject matter of Example 21, where shifting the lever downward and forward is performed as a single movement. For example, the user shifts the lever diagonally downward along a generally linear path.

Example 24 includes the subject matter of any of Examples 21-23 and further comprises pivoting the lever to the first unlocked position, thereby moving the locking mechanism to the first unlocked position.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. An adjustable firearm stock comprising:

a beam extending longitudinally along a beam axis, the beam defining a plurality of recesses and a clearance channel along a bottom surface, the clearance channel extending into the beam to a second depth that is greater than a first depth of individual recesses of the plurality of recesses;

a stock body having an upper body portion and a lower body portion, the upper body portion defining a beam opening sized and shaped to slidingly receive a portion of the beam, the lower body portion defining a rear cam pathway and a forward cam pathway with first and second portions; and a lever attached to the stock body with a first pin in the rear cam pathway and a second pin in the forward cam pathway, wherein the lever is operable between a locked lever position, a first unlocked lever position, and a second unlocked lever position.

2. The adjustable firearm stock of claim 1, wherein the lever is pivotable between the locked lever position and a first unlocked lever position, and wherein the lever is translatable between the locked lever position and a second unlocked lever position.

3. The adjustable firearm stock of claim 1, further comprising:

a locking mechanism between the lever and the beam, the locking mechanism operable between a locked condition and an unlocked condition in response to movement of the lever among the locked lever position, the first unlocked lever position, and the second unlocked lever position;

wherein when the lever is in the locked lever position the locking mechanism fixes a longitudinal position of the stock body on the beam;

wherein when the lever is in the first unlocked lever position, the locking mechanism permits longitudinal adjustment of the stock body along the beam; and wherein when the lever is in the second unlocked lever position the locking mechanism permits the stock body to be slidably removed from the beam.

4. The adjustable firearm stock of claim 3, wherein the locking mechanism includes a key and a spring, wherein the spring biases the key towards engagement with the beam.

5. The adjustable firearm stock of claim 4, wherein:

the key includes a key body, a transverse block on a top of the key body, and a boss on top of the transverse block;

when the lever is in the locked position the transverse block is received in one of the plurality of recesses and the boss is received in the clearance channel; and when the lever is in the first unlocked position the transverse block is in a clearance position with respect to the beam; and when the lever is the second unlocked position the boss and the transverse block are in a clearance position with respect to the beam.

6. The adjustable firearm stock of claim 4, wherein the lower body portion of the stock body defines a void between the rear cam pathway and a forward cam pathway, wherein the key is at least partially housed in the void and the spring is between the lower body portion and a bottom of the key.

7. The adjustable stock of claim 6, wherein the key defines a spring recess, wherein the spring is at least partially housed in the spring recess.

8. The adjustable stock of claim 6, wherein the key translates within the void in response to moving the lever among the locked lever position, the first unlocked lever position, and the second unlocked lever position.

9. The adjustable firearm stock of claim 3, wherein the key further comprises posts extending laterally outward from opposite sides of the key body, wherein an inside surface of each of the first and second sidewalls defines a slot, and wherein each post is received in the slot of the respective first or second sidewall of the lever.

10. The adjustable firearm stock of claim 1, wherein the beam further defines a second plurality of recesses and a second clearance channel along a top surface, the second clearance channel extending into the beam to a fourth depth that is greater than a third depth of individual recesses of the second plurality of recesses.

11. The adjustable firearm stock of claim 1, wherein the lever defines an open region between a bottom wall, a first sidewall, and a second sidewall spaced apart from the first sidewall, and wherein part of the lower body portion is received in the open region when the lever is in the locked position.

12. The adjustable firearm stock of claim 11, further comprising protrusions extending laterally outward from the first and second sidewalls.

13. The adjustable firearm stock of claim 1, wherein the rear cam pathway and the second portion of the forward cam pathway each have a first pathway portion extending downward and a second pathway portion extending downward and forward.

14. The adjustable firearm stock of claim 1, further comprising a butt plate removably attached to a proximal end of the stock body.

15. The adjustable firearm stock of claim 1, wherein the beam generally has a rectangular cross-sectional shape.

16. A firearm comprising the adjustable firearm stock of claim 1.

17. The firearm of claim 16, wherein the firearm is selected from a rifle and a machine gun.

18. A method of adjusting a firearm stock, the method comprising:

providing an adjustable rifle stock comprising:

a beam extending longitudinally along a beam axis, the beam defining a plurality of recesses and a clearance channel along a bottom surface, the clearance channel extending into the beam to a depth that is greater than a depth of individual recesses of the plurality of recesses;

a stock body having an upper body portion and a lower body portion, the upper body portion defining a beam opening sized and shaped to slidingly receive a portion of the beam;

a lever attached to the stock body below the upper body portion, the lever pivotable between a locked position and a first unlocked position, and movable between the locked position and a second unlocked position; and a locking mechanism between the lever and the beam, the locking mechanism operable between a locked condition and an unlocked condition in response to movement of the lever among the locked position, the first unlocked position, and the second unlocked position;

shifting the lever downward and forward to the second unlocked position, thereby moving the locking mechanism to the unlocked condition; and and sliding the stock body off of the beam.

19. The method of claim 18, where shifting the lever downward and forward includes first translating the lever downward and then translating the lever forward and downward.

20. The method of claim 18, further comprising:

pivoting the lever to the first unlocked position; and adjusting a position of the stock body along the beam with the locking mechanism in the locked position.

* * * * *